US007540992B2

(12) United States Patent
Morel

(10) Patent No.: US 7,540,992 B2
(45) Date of Patent: Jun. 2, 2009

(54) METHOD FOR CONTROLLING THE HOMOGENEITY OF THE TEMPERATURE OF PRODUCTS IN A METALLURGICAL REHEATING FURNACE, AND REHEATING FURNACE

(75) Inventor: Alain Morel, Villeurbanne (FR)

(73) Assignee: Fives Stein, Ris-Orangis (FR)

( * ) Notice: Subject to any disclaimer, the term of this patent is extended or adjusted under 35 U.S.C. 154(b) by 324 days.

(21) Appl. No.: 10/553,400

(22) PCT Filed: Apr. 7, 2004

(86) PCT No.: PCT/FR2004/000866

§ 371 (c)(1),
(2), (4) Date: Dec. 19, 2005

(87) PCT Pub. No.: WO2004/094931

PCT Pub. Date: Nov. 4, 2004

(65) Prior Publication Data

US 2006/0147867 A1 Jul. 6, 2006

(30) Foreign Application Priority Data

Apr. 18, 2003 (FR) ..... 03 04877

(51) Int. Cl.
*F27B 9/14* (2006.01)

(52) U.S. Cl. ..... 266/44; 266/252

(58) Field of Classification Search ..... 266/44, 266/249, 252

See application file for complete search history.

(56) References Cited

U.S. PATENT DOCUMENTS

| | | | | |
|---|---|---|---|---|
| 4,297,093 | A * | 10/1981 | Morimoto et al. | 431/10 |
| 4,480,992 | A | 11/1984 | Okamoto | |
| 5,545,031 | A | 8/1996 | Joshi et al. | |
| 5,554,022 | A | 9/1996 | Nabors, Jr. et al. | |
| 5,639,233 | A | 6/1997 | Ruark et al. | |
| 6,334,770 | B1 | 1/2002 | Giraud et al. | |

FOREIGN PATENT DOCUMENTS

| | | |
|---|---|---|
| EP | 0 675 325 A | 10/1995 |
| FR | 2 794 132 A | 12/2000 |

* cited by examiner

*Primary Examiner*—Scott Kastler
(74) *Attorney, Agent, or Firm*—Connolly Bove Lodge & Hutz LLP

(57) ABSTRACT

The invention relates to a method for controlling the homogeneity of the temperature of metallurgical products (B) in a reheating furnace (5) fitted with lateral burners. According to said method, the lateral burners are operated by on/off control, and the operating time and the down time of each burner is regulated in order to obtain the desired temperature. Inshot burners (1-4) are used as the lateral burners. Said burners are operated either at a speed which is close to the maximum speed or at the maximum speed, and the ignition order of the burners (1-4) is selected in such a way as to stimulate the stirring and circulation of the fumes in order to reduce the hot spot of the flame and to improve the homogeneity of the temperature of the walls of the furnace and the products.

10 Claims, 3 Drawing Sheets

METHOD FOR CONTROLLING THE HOMOGENEITY OF THE TEMPERATURE OF PRODUCTS IN A METALLURGICAL REHEATING FURNACE, AND REHEATING FURNACE

The invention concerns a process for controlling the temperature homogeneity of iron and steel products, in particular slabs and billets, in a reheat furnace equipped with lateral burners.

The function of reheat furnaces in steelworks is to raise the products to a given rolling temperature, with good temperature homogeneity at all points of the product.

The heating of the furnaces is traditionally obtained through burners fed with air and fossil fuel and disposed on the walls of the furnace. The burners are characterized by their power and the shape of their flame for various working regimes that depend on their design and on the pressures and flow rates of fuel and oxidizer. This flame generally exhibits a characteristic thermal profile with the presence of a hot point where a considerable share of the release of energy and of radiation is concentrated. The control of the position of the hot point of the flame is not simple since this position is variable and depends on the regime of the burner which itself depends on the thermal demand of the furnace.

The thermal profile of the flames produced by the burners has a direct influence on the temperature distribution of the walls of the furnace and of the products situated in proximity thereto which more or less directly reproduce the same form of temperature distribution depending on the position of the hot point of the flame.

The temperature differences over the product will be all the greater when the hot point of the flame of the burner is concentrated and when its temperature is considerable with respect to that of the surface of the product.

Temperature differences will also be created over the product if there are obstacles to the radiation between the hot point of the flame and the product, which are caused for example by a product support creating a shadow effect.

The products, if they are exposed to considerable radiation, also tend to be hotter at their ends since, apart from their two main faces (upper and lower), their ends are also exposed to the radiation of the flames or of the walls. This phenomenon is accentuated by the influence of the hot point of the flame on the lateral wall of the furnace which participates in the overheating of the ends of the product.

The thinnest products placed between batches of thick products and exposed to an identical thermal regime would also be overheated and vice versa.

To compensate for these imperfections of the heating means, it is generally found that on exit from the furnace, the products are reheated to a temperature several tens of degrees greater than the ideal rolling temperature so as to guarantee that all their points lie above this temperature. The temperature heterogeneities, and in particular the cold points, will however produce considerable loads in the cages of the rolling mill and perceptible variations of thickness or of shape in the finished product.

The reducing of the temperature differences in the products reheated in furnaces has always been a considerable preoccupation of users and builders of furnaces and undertaken along several avenues, for example:

- better location of burners in the furnace and/or an increase in their number with a lower unit power,
- improved management of the burners with modulation of the position of their hot point and of the time during which the burner is used.

In particular, according to FR-A-2 794 132 (99 06725) it is known to operate the lateral burners in bang bang mode, and to adjust the operating and stoppage time of each burner to obtain the desired temperature.

According to this state of the art, the heating in the products is managed by controlling the position of the hot point by making local use of the radiation of the flames and of the combustion flue gases and by taking account of the features and imperfections of their distribution. The search for a product which is homogeneous in temperature on exiting the reheat furnace has developed essentially by taking account of the imperfections of the temperature distributions in the flames of burners and by trying to address this through means for correctly positioning the heating energy on a bed of products.

The management of local overheating according to FR-A-2 794 132 is efficacious but has limits since it leads to growing complexity of burners and of furnace control/drive equipment for obtaining, with a computer algorithm, separate management of the position of the hot points of the burners as a function of the positions of the products and of the temperature measurements carried out at the furnace exit.

Furthermore, despite the complexity of the control of the thermal map of the furnace, it is found that a small but significant residual heterogeneity remains, related to the high temperature difference between the hot point of the flame and the products and the walls of the furnace and also related to the considerable shadow effects, this being so for each operating regime of the burner. These heterogeneities manifest themselves through temperature differences between the ends of the product and its centre as well as through the presence of cold points situated on the products where they rest on the supports situated in the furnace.

U.S. Pat. No. 4,281,984 proposes an alternating ignition of the burners and modifications of the flow rates of oxidizer and/or of fuel, this leading to modifications of the operating regime of the burners. This is not favourable for good efficiency of the burner, nor for a homogeneous temperature.

An aim of the invention is to provide a process which, while remaining relatively simple and economic to implement, ensures better temperature homogeneity of the products reheated in steelworks furnaces so as to limit the appearances of defects of the rolling operations.

According to the invention, a process for controlling the temperature homogeneity of iron and steel products, in particular of slabs or billets, in a reheat furnace equipped with lateral burners on each of two opposite sides, parallel to the direction of movement of the products in the furnace, according to which process the lateral burners are operated in bang bang mode, and the operating and stoppage time of each burner is adjusted to obtain the desired temperature, is characterized in that spread-flame burners are chosen as lateral burners, that these burners are operated at a regime close to the maximum regime or at the maximum regime, and that the order of ignition of the burners is chosen to promote the swirling and the circulation of the flue gases so as to reduce the hot point of the flame and to obtain a better temperature homogeneity of the walls of the furnace and of the products.

Spread-flame burners that may be suitable are described in FR-A-2 784 449 (98 12824).

By virtue of the particular implementation of spread-flame burners operating in "bang bang" mode and used in such a way as to reduce to the maximum the presence of hot points in the flame and the flue gases developed in the enclosure of the furnace, the temperature homogeneity of the reheated products is improved. The uniformization of the temperatures of the flue gases and of the walls of the furnace substantially reduces the drawbacks inherent in the presence of the hot points in the flames of furnaces produced in accordance with the state of the art.

Advantageously, provision is made to equip the furnace with at least two burners on each of its lateral walls, and the order of ignition of these burners is provided so as to promote the swirling and the circulation of the flue gases.

Preferably, the modification of the circulations of the flue gases in the enclosure of the said furnace is driven by a computer using mathematical control algorithms based on a thermal objective with regard to the product.

The computer can be made to control the thermal distribution, in particular the longitudinal and/or transverse curve, of temperature of the furnace, as a function of the position of the charge, of its characteristics and of its progress along the length of the furnace and of the temperature and exit temperature distribution objective sought for this product.

The computer can be made to control the order of ignition of the burners and the instant at which these burners are ignited so as to reduce the pressure variations inside the furnace and in the circuits for feeding the burners with fuel and oxidizer.

The computer can be made to control the thermal distribution of temperature in the furnace as a function of a forthcoming manufacturing program on removal from the furnace, and of a rolling program on exit, so as to optimize the heating characteristics of the products.

The adjusting of the distribution of power injected into the enclosure can be carried out in such a way as to favour the recuperation of energy in the entrance zone of the furnace.

The distribution of the thermal power injected in the longitudinal and transverse direction of the furnace can be deduced from measurements made during the rolling operation.

The thermal profile of the furnace and the longitudinal thermal profile of the product delivered by the furnace can be computed automatically by a computer using mathematical models, fuzzy logic systems or algorithms of neuro-predictive or other type.

The invention also concerns a furnace for reheating iron and steel products, in particular slabs or billets, which furnace is equipped with lateral burners, comprising drive means for operating the lateral burners in bang bang mode, and for adjusting the operation and stoppage time of each burner with a view to obtaining the desired temperature, characterized in that the lateral burners are spread-flame burners, that these burners are driven in such a way as to operate at a regime close to the maximum regime or at the maximum regime, and according to an order of ignition suitable for promoting the swirling and the circulation of the flue gases so as to reduce the hot point of the flame, the pressure variations in the furnace and the circuits for feeding the burners and to obtain a better temperature homogeneity of the walls of the furnace and of the products.

The invention consists, apart from the provisions set forth hereinabove, of a certain number of other provisions that will be dealt with more explicitly in regard to exemplary embodiments described in detail with reference to the appended drawings, but which are in no way limiting. In these drawings.

Figure 1:
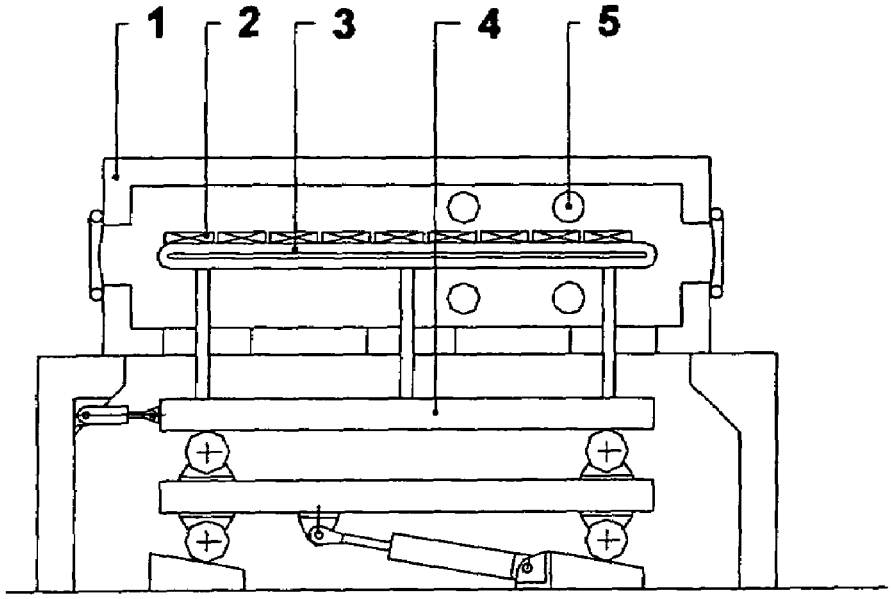
FIG. 1 is a section in elevation of a furnace for reheating iron and steel products according to the invention.

Referring to FIG. 1, presented diagrammatically therein is a reheat furnace composed of an insulated enclosure 1, the iron and steel products 2 to be reheated are supported inside the furnace by 3 and moved by a mechanism 4, from the right of the figure to the left. Spread-flame burners 5 are installed on the lateral walls of the furnace, above and below the bed of products 2.

Figure 2:
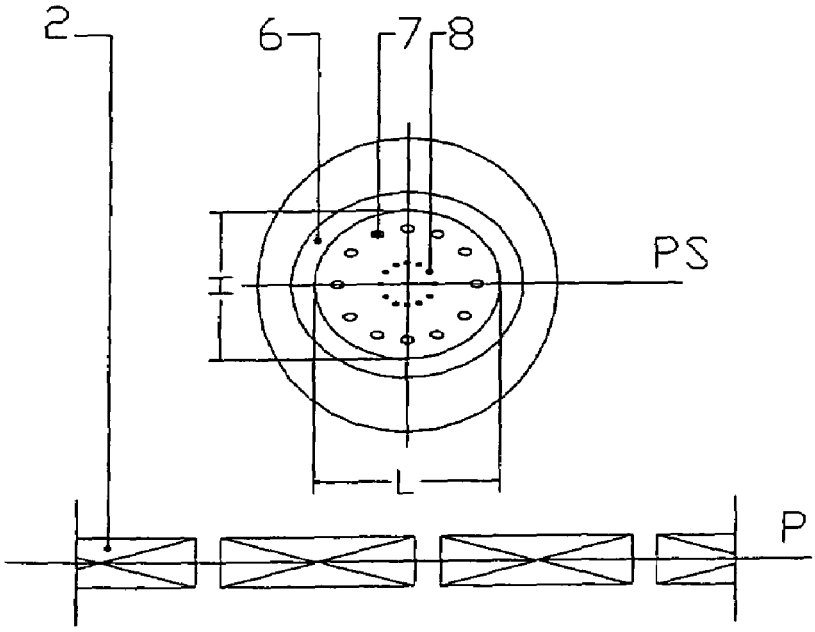
FIG. 2 is a schematic view of a spread-flame burner.

FIG. 2 diagrammatically presents a spread-flame burner furnished with a combustion tunnel 6 exhibiting a broad shape with L equal to at least 1.3×H and injection orifices for fuel 8 and for oxidizer 7 that are substantially parallel to the major axis of symmetry of the tunnel PS and are parallel to the plane P of the products situated in the furnace. The orientation of the fuel and oxidizer injection orifices is chosen in such a way as to create a difference in distribution of the combustion products and of the recycled flue gases so as to obtain a spread flame ensuring a homogeneous distribution of the thermal flux.

Figure 4:
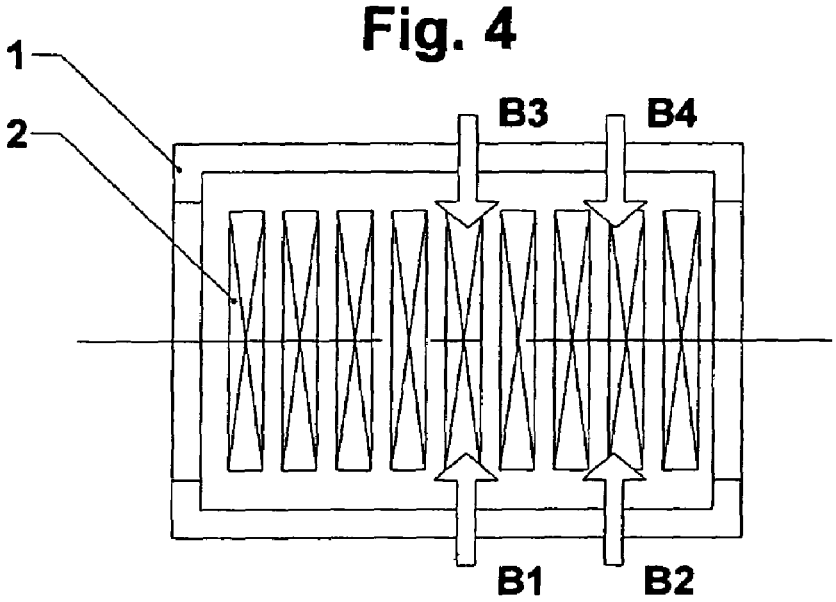
FIG. 4 is a diagrammatic and partial plan section of a furnace according to the invention with a pair of burners installed on each of its lateral walls.

Referring to FIG. 4, diagrammatically presented therein is an example of a furnace according to the invention presented in a plan and sectional view. This furnace is equipped with four spread-flame burners B1 to B4 equipping a furnace 1. The iron and steel products to be reheated 2 are supported and moved from left to right in the figure. Either side of the furnace on the lateral walls, at least four burners B1, B2, B3 and B4 are provided above and below the plane P of the products. The burners B1 and B3 are respectively upstream of the burners B2 and B4 along the direction of movement of the products in the furnace. The burners B1 and B3, as well as the burners B2 and B4 are installed facing one another.

Spread-flame burners such as these are taught by FR-A-2 784 449, the description of which is incorporated, by reference, into the present description.

A spread-flame burner, by dint of its design, is intended to produce a spread flame for all operating regimes, but under conditions that may vary.

Figure 3:
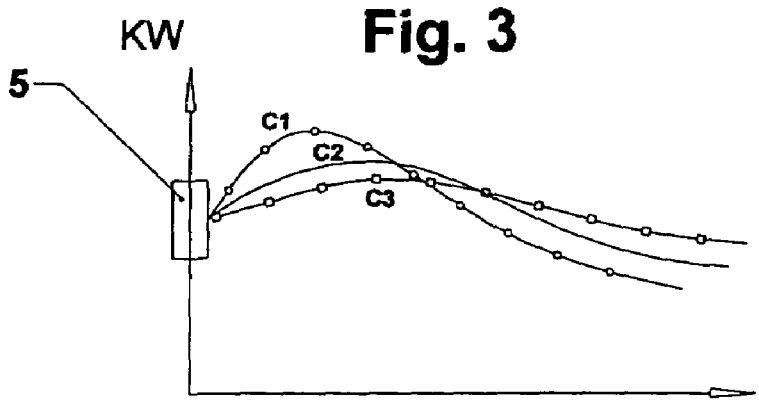
FIG. 3 is a chart diagrammatically representing the distribution according to several operating regimes of the thermal flux of a spread-flame burner 5 in a transverse plane of the furnace, the variation in the thermal flux is plotted along the ordinate, plotted along the abscissa is the distance from the lateral wall of the furnace supporting the burner.

FIG. 3 presents, for example for the burner 5 viewed in a transverse plane of the furnace, the distribution of the energy or of the thermal flux in kW plotted along the ordinate as a function of distance, presented as abscissa, from that lateral wall of the furnace 1 in which this burner is installed. The curves C1, C2 and C3 show the distribution of the thermal flux of this burner for various working regimes. The curve C1 shows the operation of the burner in the low regime, curve C2 for an intermediate regime and curve C3 for the maximum or flat out regime.

It is found that as a function of the working regime, the spreading of the flame, along the width of the furnace 5, is better for the regimes close to the maximum along curve C3. FIG. 3 shows that, at low regime, the hot point of the burner is situated near the furnace wall that will be overheated, bringing about the overheating of the ends of the products with, on exit from the furnace, the characteristic product thermal profile with hotter ends than the centre.

According to the invention, the spread-flame burners B1-B4 are operated near to, or at, their maximum regime, in bang bang mode, and according to an order of ignition suitable for promoting the swirling and the circulation of the flue gases so as to reduce the hot point of the flame and to obtain better temperature homogeneity of the walls of the furnace and the products.

This makes it possible to improve the distribution of thermal energy. The optimization of the technology of the burner for a single operating regime close to the maximum makes it possible to reduce the emissions of pollutants in the combustion gases produced.

The full-regime operation of the burners with very considerable gas speeds at the charging door allows the thermal energy to be better distributed over the entire surface of the flame, and the flue gases in the enclosure of the furnace to be swirled and circulated. This results overall in an additional reduction of the hot point of the flame in favour of a better distribution of the thermal energy over the walls and over the products.

The reduction in the hot point of the flame, the swirling and the circulation of the flue gases in the furnace caused by the "bang bang" operating cycle of the burners, allow homogenization of the radiation of the entire mass of the flue gases which produces a homogeneous exchange of heat of the walls of the furnace and of the products. The shadow effects caused for example by the supports 3 on the lower face of the products 2 are also greatly reduced by virtue of the uniformization of the temperatures of the flue gases and of the walls of the furnace which equalize the transmission of heat over the surface of the product and also over the supports themselves which are over their entire surface at the temperature of the walls. The result is that the product removed from the furnace has a better temperature homogeneity that allows a better quality of rolling at a lower rolling temperature, hence the production of a finished product with better metallurgical and dimensional characteristics.

Figure 5:
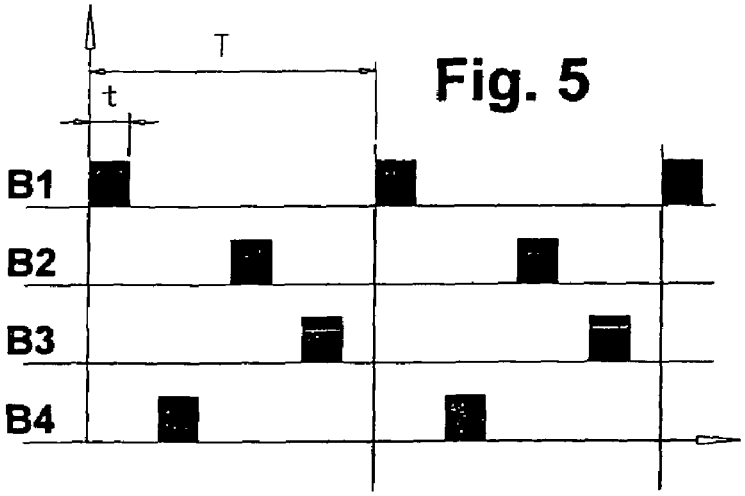
FIG. 5 is a chart illustrating an example of order of ignition of the burners of the furnace in an ignition cycle.

A first example of an order of ignition of the burners B1 to B4 is provided by the sequence presented in FIG. 5. For each burner, the time is represented as abscissa and, the working state corresponding to a symbolic non-zero ordinate level and the stoppage state corresponding to a zero ordinate have been represented as ordinate. Operation therefore corresponds to a slot whose length represents the duration at a regime close to the maximum; non-operation or stoppage of the burner corresponds to a span of zero ordinate. For a burner ignition cycle time "T", the duration "t" of operation of each burner is a fraction of the time corresponding, for a given instant, to a fraction of the total power invested in the zone of the furnace and required for the heating needs of the charge present in this zone. According to FIG. 5, the durations of operation of each burner are the same.

The order of operation (FIG. 5) of the burners for a cycle is as follows: B1, B4, B2, B3. With the disposition of FIG. 4, the simultaneous or successive operation of burners B1 and B4 causes a clockwise rotation of the flue gases; next, the simultaneous or successive operation of burners B2 and B3 causes an anticlockwise rotation of the flue gases.

The alternate ignition of burners B1 and B2, and then B3 and B4 makes it possible to alternate the direction of circulation of the flue gases inside the furnace in the corresponding zone.

Figure 6:
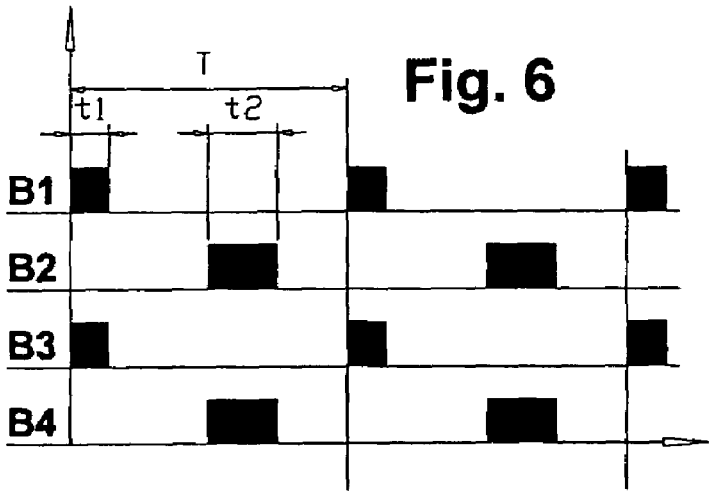
FIGS. 6 to 8 are charts illustrating, similar to FIG. 5, other examples of orders of ignition of the burners.

FIG. 6 presents another example of an order and duration of ignition of the burners B1 to B4 of the furnace of FIG. 4. Burners B1 and B3 operate simultaneously, as do burners B2 and B4. These two pairs of burners operate alternately. Furthermore, burners B2 and B4 operate for a time "t2" greater than the time "t1" of operation of burners B1 and B4 thereby making it possible to inject more thermal energy into the zone of the furnace which corresponds to burners B2 and B4 so as to tailor the thermal power injected to the need of the charge present in this part of the furnace.

Figure 7:
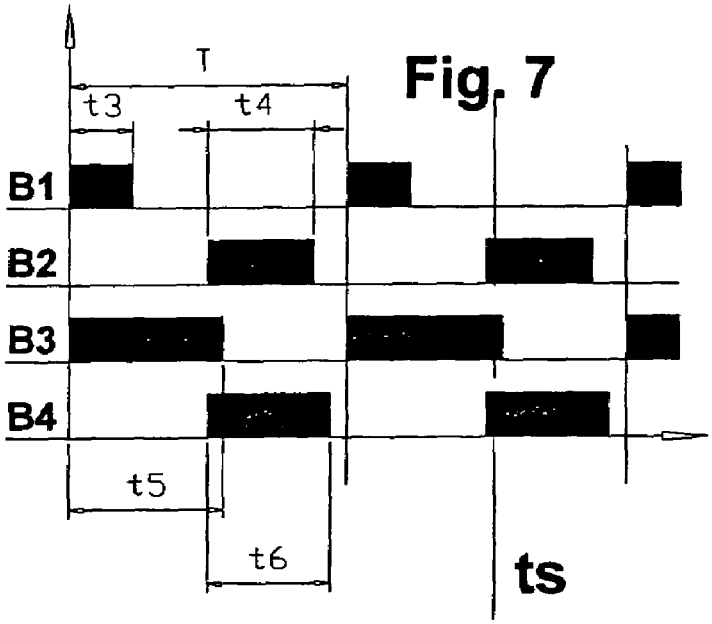

FIG. 7 presents another example of an order and duration of ignition of the burners, for which each burner operates for a given time (B1, t3), (B2, t4), (B3, t5) and (B4, t6) corresponding to the thermal demand corresponding to the part of the furnace opposite each of the burners. In this figure it may be seen that, for the instant denoted "ts", three burners are operating while for the instant denoted "tr", no burner is operating. It is understood that the operation of the furnace according to this mode will give rise to considerable variations of the pressure levels in the furnace and in the circuits for feeding the burners with fuel and oxidizer between the instants ts and tr and, more generally at the time the burners are ignited and extinguished.

Figure 8:
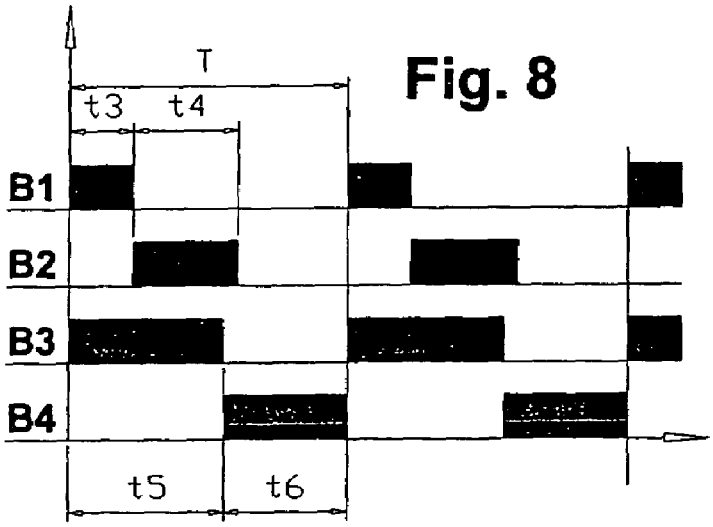

FIG. 8 presents a different arrangement of the ignitions of the burners B1 to B4 for respective durations t3 to t6 identical to those of the case of the working of the furnace defined in FIG. 7. In this figure it is seen that, at the maximum, two burners are ignited simultaneously and that, at no moment are all the burners extinguished. It is understood that for this figure, the pressure variations in the furnace and in the burner feed circuits will be much smaller than for the working case described by FIG. 7.

It is clear that numerous orders of ignition are usable to modify the swirling of the flue gases in the furnace and/or the distribution of the thermal power in the furnace and/or to limit the variations of the pressure of the furnace or of the pressures of the circuits for feeding the burners with fuel and oxidizer. This principle can be carried over to furnaces of considerable dimensions, equipped with a bigger number of burners than that adopted in the example. The principles of ignition of the burners may also be tailored for the burners situated above and below the plane P of the products.

The same principle of adaptation of the durations of operation of each burner equipping the furnace as a function of its position makes it possible to control the map of the temperatures in the furnace as a function of the local characteristics of the charge in the furnace or of the thermal characteristics of the product to be removed from the furnace.

In particular, the adjusting of the distribution of power injected into the enclosure of the furnace is carried out in such a way as to favour the recuperation of energy in the entrance zone of the furnace by giving priority to the ignition of the burners situated at the exit of the furnace so as thereby to lengthen the heat recuperation zone situated at the entrance of the furnace.

The control of the map of the temperatures and of the distribution of the thermal power in the furnace allows the monitoring of the heating of a particular product or of all the products contained in the furnace during their entire residence time in the furnace.

Combined operation of all of the burners of the furnace for a time defined by the energy needs of the products (computer or regulators) allows tailored distribution of the thermal charge in the furnace by virtue of the technology of the spread-flame burners used in bang bang mode and of the swirling of the combustion gases that is obtained by control of the order of ignition of these burners.

Combined operation of all the burners of the furnace for a time defined by the energy needs of the products and ignition of these burners according to a defined sequence (computer or regulators) makes it possible to reduce the pressure variations in the furnace and in the circuits for feeding the burners with fuel and oxidizer.

The furnace 1 preferably comprises a computer using mathematical control algorithms based on a thermal objective with regard to the product for driving the order and the duration of ignition of each burner and so as to drive the modification of the circulations of the flue gases in the enclosure of the said furnace.

The sensors with which the furnace 1 is equipped provide the computer with information allowing it to control the thermal distribution, in particular the longitudinal and/or transverse curve of the temperature of the furnace, as a function of the position of the charge of the products, of its characteristics and of its progress along the length of the furnace and of the temperature and exit temperature distribution objective sought for this product.

The computer comprises means for inputting data so as to make it control the thermal distribution of temperature in the furnace as a function of a forthcoming manufacturing program on removal from the furnace, and of a rolling program on exit, so as to optimize the heating characteristics of the products.

Information such as the temperature or the distribution of temperature in the product and which emanates from the rolling equipment may be entered into the computer for running the furnace so as to deduce therefrom the distribution of thermal power to be injected in the longitudinal and transverse direction of the furnace so as to improve the temperature homogeneity of the products to be removed from the furnace.

For its operation, the computer can use mathematical models, fuzzy logic systems or algorithms of neuro-predictive type to compute (determine) the thermal profile of the furnace and the longitudinal thermal profile of the product to be delivered by the furnace.

The invention affords the advantages listed below.

The burners operate at fixed regime, resulting in optimization of the distribution of thermal energy over the entire surface of the "spread" flame and better swirling of the flue gases in the furnace. The flames produced no longer have any hot point, or have a less pronounced hot point, thereby avoiding concentrated radiation generating temperature differences over the walls of the furnace and over the products or shadow effects on the products. The fixed regime also allows optimization of the discharges of pollutants (for example NOx, CO, $CO_2$), of the oxygen content in the furnace, hence reduction of the surface oxidation of the products and of the "loss on ignition".

The swirling of the gases in the furnace gives rise to a reduction in the temperature differences between the flue gases, the walls, the supports of products and the products in the furnace, thereby making it possible to obtain a more temperature-homogeneous product.

The reduction of the hot points of the flame and the equalization of the temperatures of flue gases and of walls make it possible to limit the shadow effects of the supports on the products and also make it possible to equalize the temperature of these supports (elimination of the "one face hot/one face cold" effect), hence give rise to a considerable reduction in the black marks on the products.

The equalization of temperature of the flue gases in the furnace makes it possible to reduce the overheating of the walls of the furnace and the influence of these walls on the ends of the product with a consequent reduction in the "hot head and tail" effect characteristic of the furnaces according to the state of the art.

The uniform distribution of the thermal fluxes in the furnace reduces the constraints of positioning of the products in the furnace. The charge of the furnace can therefore be placed more freely, for example as a function only of the mechanical loads taken up by the supports.

The reduction in the pressure variations in the furnace limits the incursions of stray air which brings about the reduction in the oxidation of the surface of the products and the "loss on ignition".

The better homogeneity of the products makes it possible to reduce the safety overheating frequently used in conventional furnaces to take account of the temperature heterogeneities of the products. The energy consumption of the furnace is therefore reduced according to the invention.

The optimization of the active hot length of the furnace, that is to say for which the burners are operating, makes it possible to increase the length of the recuperation zone and thus to reduce the consumption of the furnace.

The invention claimed is:

1. A reheat furnace process for reducing a hot point of the flames of a burner and continuously moving iron and steel products through the furnace resulting in control of the temperature homogeneity of the products in the furnace which is equipped with lateral burners, the process comprising the steps:

providing at least two spread flame lateral burners on each lateral wall of the furnace;

operating the lateral burners in bang bang mode, the operating and stoppage time of each burner adjusted to obtain a desired temperature;

operating the burners at a regime close to or at maximum state, choosing the order of ignition of the burners to— a) promote swirling and circulation of the flue gases so as to reduce a hot point of the flame and to obtain a better temperature homogeneity of walls of the furnace and of the products; and b) reduce the pressure variations in the furnace and in circuits for feeding the burners with fuel and oxidizer wherein burners are started and stopped for modifying the circulations of the flue gases in an enclosure of the furnace by a computer using mathematical control algorithms based on a thermal objective defined for the product; and wherein the computer controls thermal distribution selectively in accordance with longitudinal and/or transverse curves of temperature of the furnace, as a function of the position of a charge, of its characteristics and of its progress along the length of the furnace and of the temperature and exit temperature distribution objective sought for the product.

2. A furnace for reheating iron and steel products comprising:

means for continuously moving iron and steel products through the furnace;

at least two spread flame lateral burners on each lateral wall of the furnace;

means for operating the lateral burners in bang bang mode wherein operating and stoppage time of each burner is adjusted to obtain a desired temperature;

the operating means further operating the burners at a regime close to or at a maximum state;

means for ordering the ignition of the burners to— a) promote swirling and circulation of the flue gases so as to reduce a hot point of the flame and to obtain a better temperature homogeneity of walls of the furnace and of the products; and b) reduce the pressure variations in the furnace and in circuits for feeding the burners with fuel and oxidizer;

wherein burners are started and stopped for modifying the circulations of the flue gases in an enclosure of the furnace by a computer using mathematical control algorithms based on a thermal objective defined for the product; and wherein the computer controls thermal distribution selectively in accordance with longitudinal and/or transverse curves of temperature of the furnace, as a function of the position of a charge, of its characteristics and of its progress along the length of the furnace and of the temperature and exit temperature distribution objection sought for the product.

3. A process according to claim 1, wherein the computer controls thermal distribution of temperature in the furnace as a function of a manufacturing program on removal from the furnace, and of a rolling program on exit, so as to optimize the heating characteristics of the products.

4. A process according to claim 1, wherein adjustment of distribution of power injected into the enclosure favors the recuperation of energy in an entrance zone of the furnace.

5. A process according to claim 1, wherein the distribution of thermal power injected in longitudinal and transverse directions of the furnace can be deduced from measurements made during the rolling operation which follows reheating.

6. A process according to claim 1, wherein a thermal profile of the furnace and a longitudinal thermal profile of the product delivered by the furnace are computed automatically by a computer using mathematical models, fuzzy logic systems or algorithms of neuro-predictive type.

7. A furnace for reheating iron and steel products according to claim 2, together with a computer using mathematical control algorithms based on a thermal objective with regard to the product so as to drive modifications of the circulations of the flue gases in the enclosure of the said furnace.

8. A furnace for reheating iron and steel products according to claim 7, further comprising sensors for supplying the computer with information allowing it to selectively control the longitudinal and/or transverse curves of temperature of the furnace, as a function of the position of a charge, of its characteristics and of its progress along the length of the furnace and of the temperature and exit temperature distribution objective sought for the product.

9. A furnace for reheating iron and steel products according to claim 7, further comprising sensors of temperature measurements made during a rolling operation subsequent to the furnace, these sensors being linked to the computer which produces therefrom the distribution of thermal power injected in the longitudinal and transverse direction of the furnace.

10. A furnace for reheating iron and steel products according to claim 7, wherein the computer comprises means programmed with mathematical models, fuzzy logic systems or algorithms of neuro-predictive type for determining the thermal profile of the furnace and profile of the product the longitudinal thermal delivered by the furnace.

* * * * *